US006322636B1

(12) United States Patent
Matsugu

(10) Patent No.: US 6,322,636 B1
(45) Date of Patent: Nov. 27, 2001

(54) METHOD OF ARTIFICIALLY FORMING PATINA ON COPPER

(75) Inventor: Yutaka Matsugu, Kanagawa-ken (JP)

(73) Assignee: The Hiraoka Environmental Science Laboratory, Kanagawa-ken (JP)

( * ) Notice: Subject to any disclaimer, the term of this patent is extended or adjusted under 35 U.S.C. 154(b) by 0 days.

(21) Appl. No.: 09/607,932

(22) Filed: Jun. 30, 2000

(30) Foreign Application Priority Data

Jun. 30, 1999 (JP) ..... 11-185061

(51) Int. Cl.[7] ..... C23C 22/48
(52) U.S. Cl. ..... 148/269; 148/282; 216/105
(58) Field of Search ..... 148/269, 282; 216/105

(56) References Cited

U.S. PATENT DOCUMENTS 5,714,052 2/1998 Hoveling et al. .
5,747,439 5/1998 Dunn et al. .

FOREIGN PATENT DOCUMENTS

2064465-A * 7/1971 (FR) .
871606 6/1961 (GB) .
62-99547 5/1987 (JP) .
64-4493 1/1989 (JP) .

OTHER PUBLICATIONS

Derwent Abstract of Japanese Patent JP 53122637 A (Mitsubishi Metal Corp.), Oct. 26, 1978.*
Japanese Abstract for JP63140291, Ito, "Production of Wick Member for Heat Pipe" Jun. 11, 1988.
Japanese Abstract for JP1004493, Nishimura et al., "Method for Generating Artificial Patina on Copper Material", Jan. 9, 1989.
Japanese Abstract for JP53122641, Takahashi et al., "Method for Electrolytically Generating Verdigris on Surface of Copper or Copper Alloy", Oct. 26, 1978.

* cited by examiner

*Primary Examiner*—John Sheehan
*Assistant Examiner*—Andrew L. Oltmans
(74) *Attorney, Agent, or Firm*—Browdy and Neimark

(57) ABSTRACT

A method of artificially forming patina on a copper product surface comprising the steps of blowing granular sodium hydrogen carbonate powder onto the copper product surface to clean and roughen it; wetting the surface with water; and depositing granular sodium hydrogen carbonate powder onto the wet copper surface; thereby forming patina on the copper surface. The step of wetting the copper surface and the step of depositing granular sodium hydrogen carbonate powder onto the wet copper surface are preferably repeated several times. The copper surface is preferably covered with porous sheets during or after the above steps.

12 Claims, No Drawings

METHOD OF ARTIFICIALLY FORMING PATINA ON COPPER

BACKGROUND OF THE INVENTION

The present invention relates to a method of artificially forming patina on copper products, and more particularly to a method of artificially and rapidly forming uniform patina on copper product surfaces without causing environmental problems.

Patina formed on the surfaces of copper products advantageously prevents oxidization and corrosion of copper products and inhibits mold from growing on their surfaces. Another advantage of patina formed on the surfaces of copper products is decorative coloring, improving the appearance of copper products. Such advantages are appreciated in various copper works in fine arts, industrial arts, sculptures, monuments, architectures (particularly roofs and decorations) and the like having patina uniformly formed on their surfaces. Patina has also lately been used for various researches such as the creation of aseptic conditions by patina, medical applications of patina, hygienic applications of patina such as utilization of antibacterial effects, the influence of patina on plants and animals, etc.

Conventionally known as the artificial formation of patina on copper surfaces are electrolytic methods and acid application methods. In the electrolytic methods as exemplified in Japanese Patent Laid-Open No. 64-4493, a copper anode is eroded in an electrolytic solution, an electrolytic reaction causing patination on the surface of the copper anode. The electrolytic methods are, however, encountered with such problems that they are not suitable for or cannot be applied to large-scale copper products, particularly outdoor constructions such as monuments and architectures because it is difficult to process such copper products in an electrolytic solution.

In the acid application methods as exemplified in Japanese Patent Laid-Open No. 62-99547, an artificial patination solution composed mainly of hydrochloric acid and acetic acid is applied to copper products to cause patination. In these methods, however, the operations tend to be dangerous for workers, involving risks of generating acid gases detrimental to the environment. Furthermore, for processing copper products such as bronze statutes and architectures of temples and shrines often designated as cultural assets, the acid application methods cannot be used because acids may damage copper products.

For the above-mentioned reasons, neither the electrolytic methods nor the acid application methods can be used in processing outdoor constructions and large-scale copper products.

It is, thus, an object of the present invention to provide a method of artificially and rapid forming uniform patina on surfaces of copper products such as outdoor constructions and large-scale copper products without causing environmental problems.

SUMMARY OF THE INVENTION

As a result of intense research in view of the above object, the inventor has found that by blowing sodium hydrogen carbonate powder onto a surface of a copper product to remove rust and other deposits therefrom while finely roughening the surface so that copper ion is easily dissolved away from the copper surface; and by sprinkling sodium hydrogen carbonate powder onto the surface of the copper surface after wet with water spray, thereby causing sodium hydrogen carbonate powder to deposit thereon, copper ion generated from the surface of the copper product is subjected to reaction to form patina thereon; and that by repeating the steps of wetting the copper product surface with water spray and sprinkling sodium hydrogen carbonate powder thereto, the more rapid and uniform patination can be achieved. The present invention has been completed based on these findings.

Therefore, the method of artificially forming patina on a surface of a copper product according to the present invention comprises the steps of blowing or blasting sodium hydrogen carbonate powder onto a surface of a copper product to clean and finely roughen the surface of the copper product; wetting the surface of the copper product with water, and sprinkling sodium hydrogen carbonate powder onto a wet surface of the copper product.

It is preferable to use granular sodium hydrogen carbonate powder having an average particle diameter raging from 10 $\mu$m to 300 $\mu$m and having a Mohs hardness of about 2.5. Following the step of roughening the surface of the copper product, the step of wetting the surface with water spray and the step of sprinkling sodium hydrogen carbonate powder onto the wet surface of the copper product are preferably repeated a plurality of times to rapidly achieve uniform patination. The copper surface wet with a sodium hydrogen carbonate aqueous solution is preferably covered with a porous sheet such as paper, woven fabrics or non-woven fabrics to ensure uniform patination.

DETAILED DESCRIPTION OF THE PREFERRED EMBODIMENTS

[1] Sodium Hydrogen Carbonate Powder

Sodium hydrogen carbonate powder to be blown onto a surface of a copper product is required to have 1) a particle diameter enabling the sodium hydrogen carbonate particles to collide with the copper surface at a proper speed and (2) a hardness enabling the particles to roughen the copper surface finely. It is, therefore, preferable to use sodium hydrogen carbonate powder in the form of granules of agglomerated sodium hydrogen carbonate fine particles, granules having comparatively large size and porosity, such that the granules can be partially destroyed when colliding with the copper surface.

The sodium hydrogen carbonate powder in the form of granules preferably has an average particle diameter of 10–300 $\mu$m. When the granular sodium hydrogen carbonate powder has an average particle diameter of smaller than 10 $\mu$m, it is too light in weight, whereby it is likely that the granular hydrogen carbonate powder blown with the compressed air does not collide with the copper surface at a sufficient speed and may be scattered before colliding with the copper surface. With such insufficient collision speed and energy, oxides, deposits, mold, etc. will not be sufficiently removed from the surface of the copper product, while failing to roughen the surface finely enough. On the other hand, the granular sodium hydrogen carbonate powder particle having a diameter of larger than 300 $\mu$m will not be blown uniformly onto the surface of the copper product, resulting in likelihood of excessive roughening or damaging of the surface. A more preferable average particle diameter of the granular sodium hydrogen carbonate powder is in the range of 50–150 $\mu$m, and further preferably 75–100 $\mu$m.

The hardness of the granular sodium hydrogen carbonate powder is preferably about 2.5 in Mohs hardness. The sodium hydrogen carbonate powder in the form of granules having a Mohs hardness of much smaller than 2.5 will be finely destroyed into pieces on collision with the surface of the copper product, resulting in failure to remove oxides and other deposits from the surface of the copper product and to roughen the surface finely. The granular sodium hydrogen carbonate powder having a Mohs hardness of much lager than 2.5, on the other hand, will cause damage on the surface of the copper product. The permissible range of the Mohs hardness of the granular sodium hydrogen carbonate powder is 2–3.

[2] Blowing Sodium Hydrogen Carbonate Powder

To blow or blast granular sodium hydrogen carbonate powder onto the surface of the copper product, it is preferable to introduce the powder into a flow of compressed air and blow the powder-including compressed air through a nozzle of a blowing device. To blow granular sodium hydrogen carbonate powder, a dry process or a wet process may be employed.

In the dry process, only compressed air is used for blowing granular sodium hydrogen carbonate powder without using water. Employing this process, the energy of the granular sodium hydrogen carbonate powder colliding with the surface of the copper product can be the largest, thereby achieving fine roughening of the surface effectively. Because the blown granular sodium hydrogen carbonate powder is scattered after colliding with the surface of the copper product, this process is suitable in environment where the scattering of the powder is permitted.

In the wet process, on the other hand, granular sodium hydrogen carbonate powder is blown with water spray, such that the powder is not scattered after blown onto the surface of the copper product. The blown granular sodium hydrogen carbonate powder is captured by the sprayed water, whereby the powder is not scattered. The wet process is, therefore, suitable for copper roofs of temples and shrines located particularly in residential areas.

In both of the above-mentioned processes, the pressure of the compressed air blown through the nozzle is preferably in the range of 0.3–3 kgf/cm$^2$ depending on the object onto which the granular sodium hydrogen carbonate powder is blown. If the blowing pressure is not within the above range, it is impossible to fully clean the surface of the copper product while properly roughening it. Because the diameter of the nozzle is generally in the range of 5–15 mm, the flow rate of the compressed air is preferably not higher than 5 m$^3$/minute, more preferably not higher than 3.5 m$^3$/minute. At a flow rate of higher than 5 m$^3$/minute, most part of the sodium hydrogen carbonate powder is scattered. The blowing rate of the sodium hydrogen carbonate powder is preferably in the range of 0.5–1.0 kg/minute. If the blowing rate of the sodium hydrogen carbonate powder were lower than 0.5 kg/minute, the blowing step would take too long time. On the other hand, even if the blowing rate of the sodium hydrogen carbonate powder were higher than 1.0 kg/minute, no further advantages would be obtained, only resulting in increase in the amount of the sodium hydrogen carbonate powder scattered away.

Employed to blow the granular sodium hydrogen carbonate powder may be a conventional blaster device, preferably an SX line blast device "Acustrip System" (available from Super Blast Systems). The blaster device comprises a tank for sodium hydrogen carbonate powder, a duct mounted to the outlet of the tank and having an inlet for introducing the compressed air, a hose mounted to the duct, and a nozzle attached to an end of the hose. The diameter of the nozzle, the pressure of the compressed air and the average particle diameter and blowing rate of the granular sodium hydrogen carbonate powder may be properly determined depending on the size and surface conditions of the copper product.

In both of the dry process and the wet process, oxides, deposits, mold, etc. are completely removed from the surface of the copper product with the collision energy of the granular sodium hydrogen carbonate powder blown thereonto. Thus, the surface of the copper product can be roughened in the order of microns, thereby substantially increasing the surface area of the copper product and prompting copper ion to dissolve away from the copper surface. The blowing of granular sodium hydrogen carbonate powder, therefore, should be continued until the surface of the copper product is roughened finely enough.

[3] Patination Process

After being finely roughened, the surface of the copper product is slightly rinsed with water, wet with water spray and then sprinkled with sodium hydrogen carbonate powder, thereby causing sodium hydrogen carbonate powder to deposit on the surface of the copper product. The sodium hydrogen carbonate powder sprinkled is not limited to be granular, with its particle size and shape variable as long as it easily dissolves in water and generates a carbon dioxide gas.

Upon contact with water on the surface of the copper product, the sodium hydrogen carbonate powder immediately dissolves in and reacts with water to generate carbonate ion and thus a carbon dioxide gas. The copper ion dissolved into a sodium hydrogen carbonate aqueous solution reacts with the carbonate ion and/or a carbon dioxide gas to form patina having a composition of copper carbonate. Patination, once initiated, continues to proceed even after water evaporates. It takes about 4 to 5 days until patina grows to sufficiently cover the entire surface of the copper product under normal weather conditions.

To accelerate patination, it is preferable to sprinkle patina powder onto the surface of the copper product during at least one, preferably both, of the step of wetting with water spray and the step of sprinkling sodium hydrogen carbonate powder. The amount of the patina powder sprinkled is preferably in the range of 0.1–1.0% by weight based on the amount (100% by weight) of the sodium hydrogen carbonate powder sprinkled.

Because the amount of water held on the surface of the copper product is limited, sufficient patination may not be obtained in a single patination process comprising the steps of wetting with water spray and sprinkling sodium hydrogen carbonate powder. Thus, the patination may be repeated to obtain sufficient and uniform patination on the surface of the copper product. Full patination may usually be achieved by repeating the above patination process 4 to 5 times unless in midsummer or under strong sunshine, though the patination period may vary depending on the surface conditions of the copper product and weather conditions including temperature, sunshine and humidity.

Under such undesirable conditions as midsummer, strong sunshine and strong wind, water held on the surface of the copper product evaporates soon, requiring the repetition of the patination process more times, resulting in poor efficiency. It is thus necessary to prevent water from evaporating from the copper surface soon, thereby maintaining the surface of the copper product wet for a long period of time to improve the efficiency of operation. It is also desirable to improve the patination speed in each patination process. For such purpose, the copper product is preferably covered with porous sheets during or after the sodium hydrogen carbonate powder is sprinkled onto the wet surface of the copper product.

Because a carbon dioxide gas should be released from the sodium hydrogen carbonate aqueous solution on the copper product surface, porous sheets such as papers, woven fabrics or non-woven fabrics are preferably used. Among woven fabrics, cotton cloth or gauze may be used.

Because water contained in the porous sheets does not evaporate soon, the surface of the copper product is maintained wet for a long period of time, allowing the patination to continue efficiently for a long period of time. The porous sheets may be replaced in each patination process, though it is also possible to repeat the patination process on the surface of the copper product continuously covered with the same porous sheets.

The present invention will be described in detail below referring to the following examples, without intention of restricting the scope of the present invention defined by the claims attached hereto.

EXAMPLE 1

A copper product having a surface area of 30 cm by 37 cm and having rust and mold thereon was blown with granular sodium hydrogen carbonate powder by a dry method using an SX line blast device "Acustrip System." The conditions were as follows:

Granular sodium hydrogen carbonate powder;
particle size 75–100 $\mu$m
Mohs hardness 2.5
purity 99% or higher Flow rate of compressed air;
3.5 $m^3$/minute Blowing pressure of air;
2.0 kgf/$cm^2$ Blowing rate of granular sodium hydrogen carbonate powder;
0.9 kg/minute Observation with the naked eye on the surface of the copper product blown with the granular sodium hydrogen carbonate powder revealed that the copper product surface was turned matte with beautiful coppery color. This indicates that rust and mold were completely removed from the copper surface, and that the copper surface was roughened finely enough. Subsequently, the copper product surface was wet with water spray and sprinkled with a 15 g of sodium hydrogen carbonate powder having an average particle size of 100 $\mu$m. The copper product was then exposed to sunshine in this state for 4 days.

It was confirmed through the observation of the surface of the above copper product that patina was substantially uniformly formed, and that the hidden ratio of the copper surface with patina of the above copper product was about 20%.

EXAMPLE 2

The patinated copper product obtained in EXAMPLE 1 was further treated by repeating four cycles of the step of wetting the surface of the copper product with water spray and the step of sprinkling sodium hydrogen carbonate powder onto the surface, at a pace of one cycle a day (totally four consecutive days for four cycles). It was observed with the naked eye that the surface of the copper product was uniformly patinated, and that the hidden ratio of the copper surface with patina was substantially 100%.

Comparative Example 1

In the same way as in EXAMPLE 1, a copper product was blown with granular hydrogen carbonate powder by a dry method to remove rust and mold from the surface while roughening it finely, and then the copper product was exposed to sunshine for 4 days. It was observed with the naked eye that the surface of the above copper product was partly patinated, resulting in insufficiently thin patination.

Comparative Example 2

In the same way as in EXAMPLE 1 without blowing granular sodium hydrogen carbonate powder onto the surface, a copper product was wet with water spray, sprinkled with granular sodium hydrogen carbonate powder and exposed to sunshine. It was observed with the naked eye that the surface of the above copper product was partly patinated, resulting in insufficiently thin patination. The patinated surface did not look uniform, with mixed color of patina and deposits such as rust and mold.

As described above in detail, uniform patina can be formed on a surface of a copper product rapidly by the method of the present invention. The patina-forming method of the present invention using granular sodium hydrogen carbonate powder, which is water-soluble and environmentally harmless, is applicable to outdoor copper constructions without causing environment problems. The method of the present invention with such advantages is suitable for various copper works such as fine arts, industrial arts, sculptures, monuments, architectures and outdoor constructions such as temples and shrines.

What is claimed is:

1. A method of artificially forming patina on a surface of a copper product comprising the steps of:

blowing sodium hydrogen carbonate powder onto the surface of said copper product to clean and finely roughen said surface;

wetting said surface of said copper product with water; and depositing sodium hydrogen carbonate powder onto the resultant wet surface of said copper product; thereby forming patina on said surface of said copper surface.

2. The method of artificially forming patina on a surface of a copper product as set forth in claim 1, wherein said sodium hydrogen carbonate powder is in the form of granules having an average particle diameter of 10–300 $\mu$m.

3. The method of artificially forming patina on a surface of a copper product as set forth in claim 1, wherein patina powder is sprinkled onto said surface of said copper product during at least one of the step of wetting said surface of said copper product and the step of depositing sodium hydrogen carbonate powder onto the resultant wet surface.

4. The method of artificially forming patina on a surface of a copper product as set forth in claim 1, wherein after said surface of said copper product is finely roughened, the step of wetting said surface of said copper product and the step of depositing sodium hydrogen carbonate powder onto the resultant wet surface of said copper product are repeated a plurality of times.

5. The method of artificially forming patina on a surface of a copper product as set forth in claim 4, wherein said surface of said copper product is covered with a porous sheet, during or after the step of wetting said surface of said copper product and the step of depositing sodium hydrogen carbonate powder onto the resultant wet surface.

6. The method of artificially forming patina on a surface of a copper product as set forth in claim 5, wherein said porous sheet is paper, woven fabrics or non-woven fabrics.

7. The method of artificially forming patina on a surface of a copper product as set forth in claim 2, wherein after said surface of said copper product is finely roughened, the step of wetting said surface of said copper product and the step of depositing sodium hydrogen carbonate powder onto the resultant wet surface of said copper product are repeated a plurality of times.

8. The method of artificially forming patina on a surface of a copper product as set forth in claim 7, wherein said surface of said copper product is covered with a porous sheet, during or after the step of wetting said surface of said copper product and the step of depositing sodium hydrogen carbonate powder onto the resultant wet surface.

9. The method of artificially forming patina on a surface of a copper product as set forth in claim 8, wherein said porous sheet is paper, woven fabrics or non-woven fabrics.

10. The method of artificially forming patina on a surface of a copper product as set forth in claim 3, wherein after said surface of said copper product is finely roughened, the step of wetting said surface of said copper product and the step of depositing sodium hydrogen carbonate powder onto the resultant wet surface of said copper product are repeated a plurality of times.

11. The method of artificially forming patina on a surface of a copper product as set forth in claim 10, wherein said surface of said copper product is covered with a porous sheet, during or after the step of wetting said surface of said copper product and the step of depositing sodium hydrogen carbonate powder onto the resultant wet surface.

12. The method of artificially forming patina on a surface of a copper product as set forth in claim 11, wherein said porous sheet is paper, woven fabrics or non-woven fabrics.

* * * * *